United States Patent [19]

Varela-Hernandez

[11] 4,436,284

[45] Mar. 13, 1984

[54] TENSED WIRE SUSPENSION SYSTEM

[76] Inventor: Arturo G. Varela-Hernandez, California 2040 Apt. 152, Santiago, Chile

[21] Appl. No.: 405,547

[22] Filed: Aug. 5, 1982

[51] Int. Cl.[3] ..... E04H 17/02

[52] U.S. Cl. ..... 256/35; 256/34; 256/22; 256/48

[58] Field of Search ..... 256/33, 35, 58, 52, 256/48, 45, 34, 22

[56] References Cited

U.S. PATENT DOCUMENTS

| | | | |
|---|---|---|---|
| 263,482 | 8/1882 | Chavannes | 256/35 |
| 315,767 | 4/1885 | Goodwin | 256/35 X |
| 409,597 | 8/1889 | Arnold et al. | 256/35 X |
| 519,995 | 5/1894 | Frisbee | 256/35 X |
| 602,444 | 4/1898 | Haffey | 256/35 X |

FOREIGN PATENT DOCUMENTS

| | | | |
|---|---|---|---|
| 52167 | 9/1936 | Denmark | 256/35 |
| 563088 | 11/1932 | Fed. Rep. of Germany | 256/35 |

*Primary Examiner*—Andrew V. Kundrat

*Attorney, Agent, or Firm*—Robert E. Burns; Emmanuel J. Lobato; Bruce L. Adams

[57] ABSTRACT

A system for creating fixed plane structures such as vine trellises, fences, building structures, and barriers, wherein a plurality of generally parallel wires are placed in tension and maintained in mutually spaced relation by rigid interconnecting means so that laterally directed stresses imparted to some of the wires are transmitted to the other wires to cause each of the wires to bear some of the stress. The system permits the rapid installation of long fences, trellises and the like since the wires need to be anchored only at the terminals thereof to fixed points, and may be as long as required for the particular installation.

4 Claims, 4 Drawing Figures

TENSED WIRE SUSPENSION SYSTEM

BACKGROUND OF THE INVENTION

This invention relates generally to the field of wire fencing, trellising and related structures, and more particularly to an improved system wherein such structures may be rapidly erected at relatively low cost while exhibiting substantial strength and durability.

It is known in the art to provide supports for trellis wires upon which vines grow, and to support the same in mutually spaced relation under relatively low tension against the forces of gravity. Such construction requires a relatively large number of vertically oriented supporting posts buried in the ground at periodic intervals. Where an equivalent structure is employed for fencing, the resistance of the fence to laterally exerted forces is provided only by the particular wires contacted, and the strength of the anchoring posts between the stressed spans. Thus, under the impact of vehicles or livestock, such fences are relatively easily damaged or otherwise made ineffectual.

Prior art structures have failed to utilize the inherent tensile strength of the wires forming part of the structure, and have relied only on the compressive strengths of supporting posts. As a result, the installation of trellises or fences of substantial lengths has required a large number of such posts and substantial labor in sinking the posts in the ground. Once installed, the durability of the installation is dependent upon that of the posts which can be easily damaged owing to a lack of shock resistance.

SUMMARY OF THE INVENTION

Briefly stated, the invention contemplates the provision of an improved fencing, trellising or suspension system in which the bulk of the strength and shock resistance thereof is obtained from the tension of the wires comprising the system. The system comprises a plurality of generally parallel wires of substantial length which are anchored at each end thereof to place them under considerable tension. Suitable supporting structures adjacent the ends of the wires are engaged therewith to support the same in vertical direction. At periodic intervals, the wires are interconnected to each other using rigid links which provide additional tension and serve to transmit laterally applied forces to one or more of the wires to the remaining wires to dissipate the stresses and provide a degree of shock absorptive capacity preventing damage to the structure.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
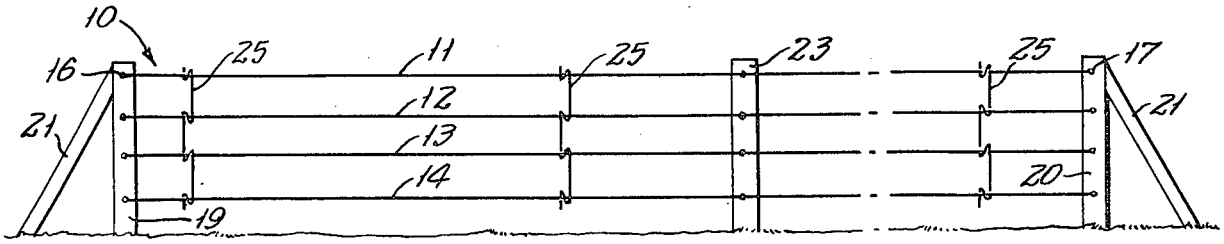
FIG. 1 is a side elevational view of a relatively simple system embodying the invention.
Figure 2:
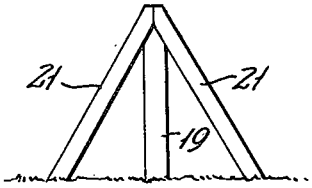
FIG. 2 is an end elevational view thereof.

In accordance with the invention, the system, generally indicated by reference character 10, includes a plurality of flexible wires 11, 12, 13 and 14, each having first and second terminals at 16 and 17.

These terminals may be anchored, as shown in the drawing upon first and second posts 19 and 20 having side reinforcements 21, or, if desired, the terminals may be secured to an anchor embedded directly in the ground. The posts maintain the wires in substantially parallel relation, and may be spaced a distance apart as required, it being possible to join individual segments of wire for the making of a single wire extending over very long distances.

Figure 3:
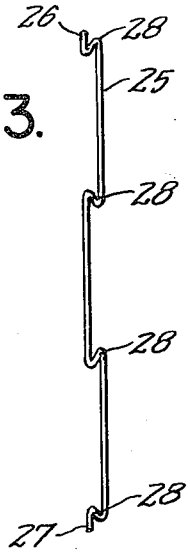
FIG. 3 is a perspective view showing a linking element forming a part of the embodiment.

To permit the change of course of the wires, as at the corner of a rectangular property or to span hills, promontories and the like, a number of auxiliary fixed posts 23 are provided, the lower ends of which are buried in the ground. However, relatively long spans may be formed, without support from the ground by the use of wire link elements 25 which are relatively rigid compared to the wires 11–14, and may be bent to the configuration shown in FIG. 3 in the drawing to provide spaced Z-shaped loops. Each of the link elements 25 includes first and second ends 26 and 27, respectively, and a plurality of normally equally spaced Z-shaped loops 28 with which portions of the wires 11–14 are engaged in non-slipping relation. The intervals at which the link elements 25 are spaced will depend, in large measure, to the degree of tension applied to the wires, the size of the wires, and the predicted degree to which lateral forces will be applied. The distances may be as little as six feet to as many as two hundred fifty feet. The linking elements have no contact with the ground or any other supporting structure, and serve only the purpose of maintaining the wires in mutually spaced relation, and, more importantly, imparting lateral stresses applied to any of the wires to the other wires so that all wires contribute to the stress reaction.

In the embodiment shown in FIG. 1, all of the wires lie in a single plane. However, where required, the link elements 25 may be of nonlinear configuration, and include loops to support the wires in any desired pattern. For example, in vine trellising in the state of California, it is common to use T-shaped supporting posts. Between such posts, T-shaped link elements (not shown) may also be employed.

Figure 4:
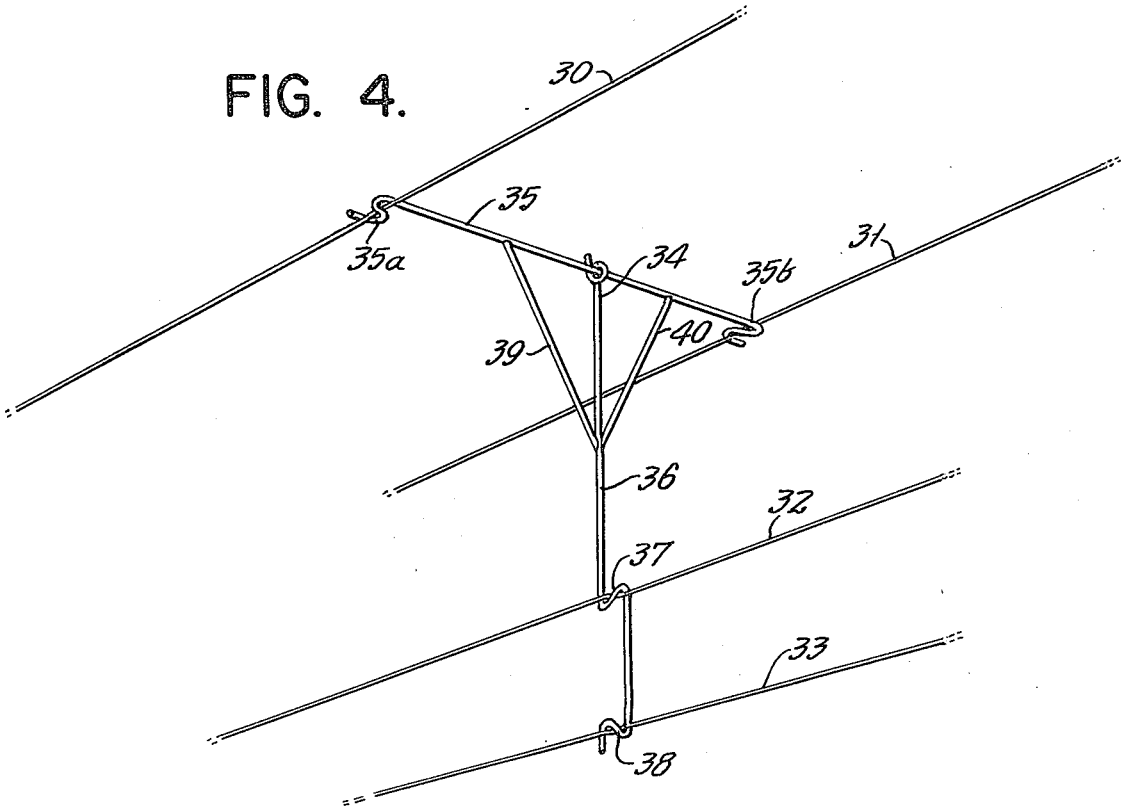
FIG. 4 is a perspective view showing a second form of linking element.

FIG. 4 shows a typical installation of a T-shaped link element used in supporting California-type trellises. In the California-type configuration, there are normally provided a pair of upper parallel wires 30 and 31 disposed in a common horizontal plane, beneath which wires 32 and 33 are disposed in a common vertical plane. The link element 34 supports a cross member 35 at the upper end thereof having loops **35*a* and 35*b* for engaging the wires 30 and 31, respectively. The vertical portion 36 includes loops 37 and 38 which engage the wires 32 and 33, respectively. Angularly disposed support members 39 and 40 maintain the member 35** in horizontal position.

Building structures, such as small aircraft hangars, barns, and other uninhabited improvements may be conveniently fabricated by constructing only a frame to which parallel wires are attached and extended between portions of the frame. Side wall panels may be attached to the wires or link elements to provide a necessary enclosure. With such skeletonized structure the cost of fabricating the improvements is materially reduced as contrasted with that of conventional building structures.

I wish it to be understood that I do not consider the invention limited to the precise details of structure shown and set forth in this specification, for obvious modifications will occur to those skilled in the art to which the invention pertains.

I claim:

1. A system for forming trellises, fences, and self-supporting structures comprising: a plurality of wires of substantially equal length, each having first and second ends; first and second means for anchoring said wires at said ends to place said wires under substantial tension and position the same in substantially mutually parallel relation; and laterally extending link elements interconnecting said plurality of wires at periodic intervals between said first and second terminals, for the transmission of laterally applied forces exerted thereon, said link elements being free of other interconnection and comprising lengths of relatively rigid wire bent at intervals to form Z-shaped loops each comprising two offset parallel portions and an angular connecting portion disposed at acute angles to said parallel portions and extending linearly therebetween, said wires being interlaced between the same sides of said parallel portions and around the facing side of said connecting portion intermediate the linear extent thereof to be held in laterally non-slipping engagement with said like elements.

2. A system in accordance with claim 1, further comprising a plurality of fixed posts disposed between said first and second terminals of said wires and having means thereon engaging said wires to maintain a mutual parallel relation therebetween, whereby the direction of said wires may be varied in horizontal and vertical planes.

3. A system in accordance with claim 1, in which each of said link elements is T-shaped, comprising a vertical portion and a horizontal portion, each having said Z-shaped loops therein for non-slipping engagement with said wires.

4. A system in accordance with claim 3, in which angle brace portions between said vertical portion and horizontal portion retain said portions in mutually perpendicular relation.

* * * * *